United States Patent [19]

Boisvert

[11] 4,206,682

[45] Jun. 10, 1980

[54] MUSICAL RHYTHM INDUCTOR

[76] Inventor: Adrien J. Boisvert, 840 Duthie Ave., Burnaby, British Columbia, Canada, V5A 2PS

[21] Appl. No.: 3,446

[22] Filed: Jan. 15, 1979

Related U.S. Application Data

[63] Continuation of Ser. No. 855,660, Nov. 30, 1977, abandoned.

[51] Int. Cl.[2] ..... G04F 5/00; G04F 5/02

[52] U.S. Cl. ..... 84/484

[58] Field of Search ..... 84/484, 470 R, 471 R, 84/474, 477 R; 58/130, 130 C, 130 R, 130 E; 35/14, 29 C, 74

[56] References Cited

U.S. PATENT DOCUMENTS

| | | | |
|---|---|---|---|
| 1,261,382 | 4/1918 | Grimson | 58/130 C |
| 1,438,144 | 12/1922 | Stevenson | 35/74 |
| 1,930,997 | 10/1933 | Fascinato | 58/130 C |
| 2,988,822 | 6/1961 | Knudsen | 35/14 |

*Primary Examiner*—L. T. Hix
*Assistant Examiner*—Shelley Wade
*Attorney, Agent, or Firm*—Townsend and Townsend

[57] ABSTRACT

A teaching aid for musicians has a circular disc eccentrically mounted on a motor-driven shaft which is rotatable at a constant, selected speed. The peripheral edge of the disc is eccentrically disposed with respect to the longitudinal axis of the shaft and portions of that edge provide a visual indication of musical rhythm or tempo as the disc rotates. A sounding device is associated with the disc to beat out time and augment the visual indication of tempo with an audible, repetitive sound.

4 Claims, 3 Drawing Figures

MUSICAL RHYTHM INDUCTOR

This application is a continuation of application Ser. No. 855,660, filed Nov. 30, 1977 now abandoned.

BACKGROUND OF THE INVENTION

This invention relates to a timing device and more particularly to an indicator of musical rhythm.

Metronomes of various types have been used for years to assist practising musicians acquire a sense of timing and it has long been recognized that such an instrument tends to make most beginners play in a rather stilted or mechanical manner. In other words, a student musician is encouraged to follow the audible beat of the metronome and as a result finds it difficult to acquire a proper or natural sense of rhythm which is so essential if any music is to be played well.

The most pertinent prior art known to applicant comprises U.S. Pat. Nos. 1,930,997 dated Oct. 17, 1933 and 1,261,382 dated Apr. 2, 1918. Each of these prior art patents disclose the use of a circular disc which is concentrically mounted in a rotatable shaft, the disc being provided with a pointer or marker which itself is concentric to the shaft. Thus both patented devices, because of this absence of eccentricity, fail to provide an appreciable or readily discernible visual indication of rhythm and therefore they rely mainly on sound to beat out an audible indication of time as do other metronomes.

SUMMARY OF THE INVENTION

The present invention induces rhythm mainly by visual means which has been found to convey a sense of time more effectively than a conventional metronome relying upon an audible output. The eccentric disc of the device is comparable is some respects to a conductors baton as used to indicate musical time. One music teacher has likened the action of the disc to that of a hoop being rotated around someones waist, that is, the action is visually rythmical and therefore interesting and stimulating to the observer. Another analogy is rope skipping when a rope is swung by two persons while a third person attempts to skip the swinging rope. That third person must watch the movement of the rope and mentally get into the rhythm of the swing before entering beneath the rope and starting to skip. The eccentric disc of this invention is like the swinging hoop or rope in that it encourages a person to relax and adopt a natural, rhythmic motion so that the forward motion or progression of the music can be followed more readily than would be the case if the tempo was given only by sound. Since a student may sometimes be distracted and loose sight of the swinging device, the present invention is capable of providing an audible indication of time as well.

According to the present invention, there is provided a musical rhythm inductor which comprises a rotatably mounted shaft, a circular disc mounted on the shaft to rotate therewith, said circular disc having a peripheral edge eccentrically disposed with respect to the axis of rotation of the shaft, and drive means for rotating the shaft at a constant speed whereby the peripheral edge of the rotating circular disc provides a rhythmic and visual indication of tempo.

BRIEF DESCRIPTION OF THE DRAWING

In drawings which indicate a preferred embodiment of the invention.

DESCRIPTION OF THE PREFERRED EMBODIMENTS

Figure 1:
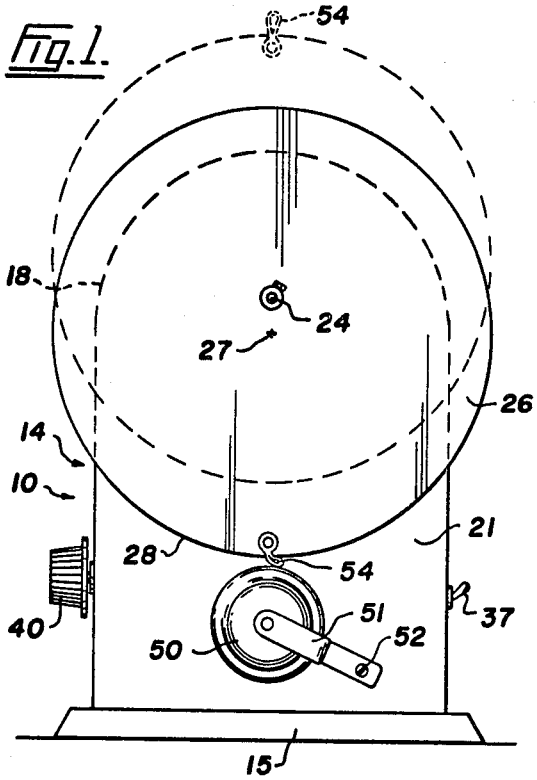
FIG. 1 is a front elevation of the present musical rhythm inductor.
Figure 2:
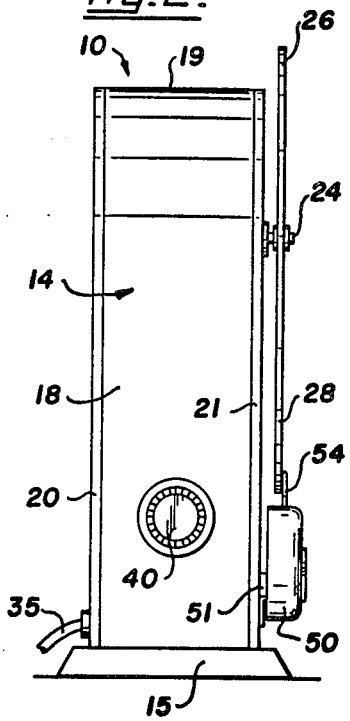
FIG. 2 is a side elevation of the inductor.

Referring to the drawings, the numeral 10 indicates generally a musical rhythm inductor constructed in accordance with the present invention.

The inductor 10 is provided with a housing 14 which preferably has a base 15, side posts 16 and 17, and a peripheral wall 18 which covers the sides of the posts and forms an upper enclosure 19 for the housing. A removable back panel 20, see FIG. 3, closes the rear of the housing and the structure has a fixed, front panel 21.

A rotatable shaft 24 projects through the front panel 21. Non-rotatably secured to the outer end of this shaft is a disc 26 which may be eight inches or more in diameter. The disc is supported so as to rotate parallel to and in close proximity with the exterior face of the front panel 21. The circular disc 26 is eccentrically mounted on the horizontally disposed shaft 24, the center 27 of the disc being spaced from the longitudinal axis of the shaft as shown in FIG. 1. Thus, the disc has a peripheral edge 28 which is eccentrically disposed with respect to the axis about which the shaft 24 rotates.

Figure 3:
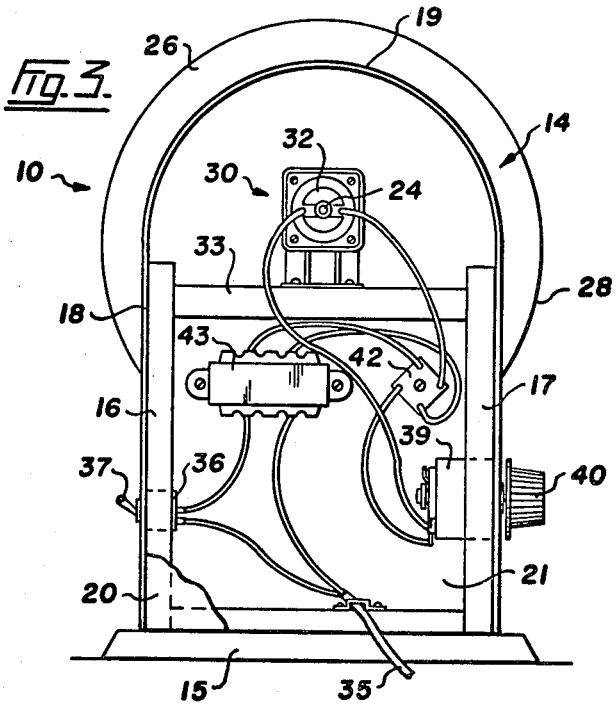
FIG. 3 is a rear elevation of the inductor with a rear panel thereof broken away to show internal parts of the device.

As shown in FIG. 3, the housing 14 encloses means generally indicated at 30 for rotating the shaft 24 and therefore the disc 26 at a selected number of revolutions per minute. The drive means 30 desirably comprises a variable speed electric motor 32 which may be mounted on a cross bar 33 carried between the posts 16 and 17. This motor is adapted to drive the shaft 24 through a suitable reduction, not shown. The means 30 includes a suitable circuit having wires 35 which extend from the housing and to connect the motor 32 to a source of electric power. A simple on-off switch 36 is connected into the same circuit and this switch may be mounted on the post 16 with an operating lever 37 of the switch accessible from the exterior of the housing. A rheostat 39 having an exterior operating knob 40 is mounted on the housing post 17. A diode 42 and a transformer 43 are also included in the circuit of the drive means 30. Such an arrangement enables the disc 26 to be rotated at an appropriate constant speed selected by the user of the inductor 10 during a practice session.

Finally, the musical rhythm inductor 10 is provided with a sounding device which preferably is a bell 50. A bracket 51 serves to mount the bell on the panel 21. The bracket is secured to the front panel by means of a clamping screw 52 which serves as a pivot so that the bell 50 can be moved in an arc towards and away from the peripheral edge 28 of the disc and then be locked in a selected position. The disc 26 is fitted with a striker 54 located on an imaginary radial line extending through the edge 28 at a point spaced a maximum distance from the center of the shaft 24. The slightly flexible striker 54 projects beyond the peripheral edge 28 so as to make contact with the bell 50 during rotation of the disc provided the bell had not been set in an out-of-reach position. Thus, the bell 50 is struck by the striker 54 once each time the disc 26 makes a complete revolution.

To operate the musical rhythm inductor 10 so as to give tempo only visually, the position of the bell 50 is adjusted to clear the intended path of travel of the striker 54. The wires 35 are plugged into a wall outlet or the like and the switch 36 is closed to start the motor 32 and rotate the disc 26. Next, the rheostat 36 is adjusted by the knob 40 to set the speed of rotation of the disc to conform to the tempo of the particular musical composition which is to be practised.

The inductor 10 need not be placed directly in the line of vision of the practising musician. Preferably, it is placed to one side or above that line so that the musician can still see the inductor indirectly without having his vision obstructed. This allows the musician to concentrate on the sheet music if it is being used and also on the keyboard in the case of piano practice. However, the musician is fully aware that the rotating eccentric disc 26 is signalling the required tempo and almost subconsciously adopts the proper rhythm needed to practice the particular piece of music before him.

As previously mentioned, the striker 54 is located on the disc so as to project across the peripheral edge 28 at a point on that edge spaced a maximum distance from the longitudinal axis of the shaft 24. Edge 28 is eccentric to that axis of rotation of the shaft and therefore an imaginary point on the peripheral edge located diametrically opposite the pointer can be said to be spaced a minimum distance from the center of the shaft. The eccentric edge 28 then has two portions centered on these maximum and minimum radii which combine, when the disc 26 is rotated, to provide the radial displacement indicated between the solid and dotted lines appearing in FIG. 1. This eccentric motion is quite easily seen by a practising musician even though he may only be observing the present rhythm indicator out of the corner of his eye while reading his sheet music. A radial pointer on the edge of a concentric disc for example, or a spot on the surface of another concentric disc, would follow concentric paths when those discs were rotated so that an observer would see perhaps blurred lines prescribed by such concentrically moving indicators and this would not provide the required visual indication of rhythm.

In normal practice, it will be desirable to bring the sounding device into play so that the inductor 10 will give the tempo audibly as well as visually. The clamping screw 52 is then loosened to allow the bell 50 to be placed in the path of travel of the striker 54 whereupon the screw is retightened. This results in the bell being struck once per revolution of the disc. The ringing of the bell accents each beat or main pulse throb of the musical composition being practiced and this will be found useful particularly by beginners.

From the foregoing, it will be apparent the musical rhythm inductor provides an extremely effective means of teaching correct musical rhythm which is so essential. The large, eccentric disc beats out time visually and in a manner which is readily understood by a pupil.

I claim:

1. A musical rhythm inductor comprising a rotatably mounted shaft, a circular disc eccentrically mounted on the shaft to rotate therewith, said circular disc having diametrically opposed peripheral edge portions spaced maximum and minimum distances from an axis of rotation of the shaft, and drive means for rotating the shaft at a constant speed whereby movement of the peripheral edge portions on the rotating circular disc provides a rythmic and visual indication of tempo.

2. A musical rhythm inductor as claimed in claim 1, and including a striker carried by the disc, and a sounding device mounted in the path of travel of the striker to be struck thereby once per revolution of the circular disc.

3. A musical rhythm inductor as claimed in claim 1, and including a control device for regulating the drive means whereby to selectively vary the speed of rotation of the circular disc.

4. A musical rhythm inductor comprising a housing having a front face, a shaft rotatably supported by the housing and having an outer end projecting beyond the front face, a circular disc eccentrically and non-rotatably mounted on the outer end of the shaft and having diametrically opposed peripheral edge portions spaced maximum and minimum distances from the longitudinal axis of said shaft, drive means for rotating the shaft and the circular disc at a constant speed whereby movement of the peripheral edge portions provides a rythmic and visual indication of tempo, a control device for regulating the drive means whereby to selectively vary the speed of rotation of the circular disc, a striker on the circular disc, and a bell carried by the housing in the path of travel of the striker to be struck thereby once per revolution of the circular disc.

* * * * *